US011326792B2

(12) United States Patent
Mergener et al.

(10) Patent No.: US 11,326,792 B2
(45) Date of Patent: May 10, 2022

(54) GRILLE ATTACHMENT SYSTEM FOR A VENTILATION SYSTEM

(71) Applicant: Broan-NuTone LLC, Hartford, WI (US)

(72) Inventors: Bradley Mergener, Hartford, WI (US); Rick Sinur, Hartford, WI (US); Ryan Revers, Hartford, WI (US)

(73) Assignee: Broan-NuTone LLC, Hartford, WI (US)

( * ) Notice: Subject to any disclaimer, the term of this patent is extended or adjusted under 35 U.S.C. 154(b) by 0 days.

(21) Appl. No.: 16/776,712

(22) Filed: Jan. 30, 2020

(65) Prior Publication Data

US 2020/0263886 A1 Aug. 20, 2020

Related U.S. Application Data

(60) Provisional application No. 62/806,219, filed on Feb. 15, 2019.

(51) Int. Cl.
*F24F 7/013* (2006.01)
*F24F 13/08* (2006.01)

(52) U.S. Cl.
CPC ..... *F24F 7/013* (2013.01); *F24F 13/084* (2013.01)

(58) Field of Classification Search
CPC ..... F24F 13/078; F24F 13/084; F24F 13/082; F24F 2007/001; F24F 7/013
USPC ..... 454/349, 330, 331, 332, 341
See application file for complete search history.

(56) References Cited

U.S. PATENT DOCUMENTS

| | | | |
|---|---|---|---|
| 1,030,028 | A | 6/1912 | Stampahar et al. |
| 1,395,833 | A | 11/1921 | Kling et al. |
| 1,532,635 | A | 4/1925 | Osbun |
| 1,713,101 | A | 5/1929 | Starrett |
| 1,886,841 | A | 11/1932 | Searles |
| 1,895,642 | A | 1/1933 | Stebbins |
| 1,941,450 | A | 1/1934 | Sylvan |
| 2,019,867 | A | 11/1935 | Nelson |
| 2,021,086 | A | 11/1935 | Oskamp |
| D107,399 | S | 12/1937 | Broadwin |
| 2,108,283 | A | 2/1938 | Drew et al. |
| D109,887 | S | 5/1938 | Fordyce |
| 2,182,690 | A | 12/1939 | Cole |
| D118,359 | S | 1/1940 | Arenberg |
| D120,266 | S | 4/1940 | Fischer |
| D120,772 | S | 5/1940 | Arenberg |
| D120,773 | S | 5/1940 | Arenberg |
| 2,220,127 | A | 11/1940 | Slayter |

(Continued)

OTHER PUBLICATIONS

U.S. Appl. No. 29/514,070, Non Final Office Action dated May 27, 2016, 26 pages.

(Continued)

*Primary Examiner* — Vivek K Shirsat
(74) *Attorney, Agent, or Firm* — Barnes & Thornburg LLP

(57) ABSTRACT

A ventilation grille having a trim ring and a plate releasably connected to the trim ring. The trim ring defines an aperture allowing connection of the trim ring to a main housing of a ventilation system defining an internal region in which a blower is located. The plate is releasably connected to the trim ring to allow access to the trim ring aperture for connection of the trim ring to the main housing or blower and disconnection of the trim ring from the main housing or blower.

19 Claims, 6 Drawing Sheets

(56) References Cited

U.S. PATENT DOCUMENTS

| | | | |
|---|---|---|---|
| 2,222,081 | A | 11/1940 | Leigh |
| D126,128 | S | 3/1941 | Eallman |
| 2,240,617 | A | 5/1941 | Harrigan |
| 2,278,581 | A | 4/1942 | MacDougald |
| D132,865 | S | 6/1942 | Drollinger |
| 2,325,657 | A | 8/1943 | Burkness |
| D153,313 | S | 4/1949 | Phillips |
| 2,472,748 | A | 6/1949 | Labus |
| 2,483,377 | A | 9/1949 | Young |
| D157,014 | S | 1/1950 | Walker |
| 2,576,860 | A | 11/1951 | Shapiro |
| D165,982 | S | 2/1952 | Kennedy |
| D166,324 | S | 4/1952 | Kurth |
| D171,505 | S | 2/1954 | Krueger |
| 2,668,491 | A | 2/1954 | Gerlitz |
| 2,673,514 | A | 3/1954 | Hanks |
| D173,120 | S | 9/1954 | Levenhagen |
| 2,689,906 | A | 9/1954 | Corbett |
| 2,697,163 | A | 12/1954 | Spear |
| 2,710,573 | A | 6/1955 | Marker |
| 2,780,981 | A | 2/1957 | Miller |
| 2,790,375 | A | 4/1957 | Broberg |
| 2,799,213 | A | 7/1957 | Hansen |
| 2,800,069 | A | 7/1957 | Smith |
| D180,727 | S | 8/1957 | Bourner |
| 2,811,094 | A | 10/1957 | Auer |
| 2,824,429 | A | 2/1958 | Zucker |
| 2,831,550 | A | 4/1958 | Bub |
| D183,117 | S | 7/1958 | Coleman |
| 2,875,678 | A | 3/1959 | Shepherd |
| 2,911,900 | A | 11/1959 | Rudy |
| 2,939,377 | A | 6/1960 | Stach |
| 2,963,956 | A | 12/1960 | Hill |
| 2,987,258 | A | 6/1961 | North |
| 2,996,972 | A | 8/1961 | Johansson |
| 3,001,056 | A | 9/1961 | Spear |
| 3,002,676 | A | 10/1961 | Papsdorf |
| D192,312 | S | 2/1962 | Hart |
| 3,028,475 | A | 4/1962 | Nash |
| 3,045,579 | A | 7/1962 | Jenn et al. |
| D193,868 | S | 10/1962 | Bloomfield |
| 3,064,548 | A | 11/1962 | Field |
| 3,068,341 | A | 12/1962 | Ortiz et al. |
| 3,075,335 | A | 1/1963 | Bandlow |
| 3,097,287 | A | 7/1963 | Knoll et al. |
| 3,101,662 | A | 8/1963 | Alldritt |
| D196,618 | S | 10/1963 | Hammes |
| D199,045 | S | 9/1964 | Everts |
| 3,211,080 | A | 10/1965 | Rader |
| 3,212,425 | A | 10/1965 | Hazen et al. |
| 3,215,828 | A | 11/1965 | Bonvallet et al. |
| 3,249,037 | A | 5/1966 | Stalker |
| 3,250,063 | A | 5/1966 | Andrews |
| 3,276,597 | A | 10/1966 | Mesek et al. |
| 3,326,112 | A | 6/1967 | Sadlow et al. |
| 3,332,334 | A | 7/1967 | Melzer |
| 3,347,025 | A | 10/1967 | Wiley |
| 3,391,689 | A | 7/1968 | Roger |
| 3,438,180 | A | 4/1969 | Klouda |
| 3,460,322 | A | 8/1969 | Rivers et al. |
| 3,572,234 | A | 3/1971 | Schoenthaler |
| 3,577,710 | A | 5/1971 | Feldman |
| 3,606,593 | A | 9/1971 | Steiner |
| 3,630,007 | A | 12/1971 | Neumann |
| 3,636,306 | A | 1/1972 | Bumpus |
| 3,665,838 | A | 5/1972 | Shepherd |
| 3,692,977 | A | 9/1972 | Duhamel et al. |
| 3,698,833 | A | 10/1972 | Cann et al. |
| 3,732,030 | A | 5/1973 | Mullings |
| 3,743,439 | A | 7/1973 | Cann |
| D229,181 | S | 11/1973 | Bledsoe |
| 3,777,650 | A | 12/1973 | Wenig |
| 3,785,271 | A | 1/1974 | Joy |
| 3,788,207 | A | 1/1974 | Doherty |
| 3,861,894 | A | 1/1975 | Marsh |
| 3,875,678 | A | 4/1975 | Vits |
| 3,926,537 | A | 12/1975 | Piper |
| 3,952,638 | A | 4/1976 | Felter et al. |
| D244,764 | S | 6/1977 | Grubauer |
| D244,854 | S | 6/1977 | Salamone |
| 4,073,597 | A | 2/1978 | Barnhart et al. |
| 4,115,082 | A | 9/1978 | Newell |
| 4,141,703 | A | 2/1979 | Mulchi |
| 4,203,332 | A | 5/1980 | Corsetti |
| D256,047 | S | 7/1980 | Wormington |
| D257,060 | S | 9/1980 | Mann |
| D258,083 | S | 1/1981 | Gammell |
| 4,252,547 | A | 2/1981 | Johnson |
| D261,803 | S | 11/1981 | Bohanon |
| D262,457 | S | 12/1981 | Swales |
| 4,319,898 | A | 3/1982 | Maierhofer |
| 4,335,647 | A | 6/1982 | Timmons |
| 4,336,749 | A | 6/1982 | Barnhart et al. |
| D267,828 | S | 2/1983 | Cohen |
| D268,952 | S | 5/1983 | Anderson |
| 4,382,440 | A | 5/1983 | Kapp et al. |
| 4,385,550 | A | 5/1983 | Steiner et al. |
| 4,385,911 | A | 5/1983 | Popeil et al. |
| 4,406,216 | A | 9/1983 | Hott et al. |
| D271,984 | S | 12/1983 | Nelson et al. |
| D275,988 | S | 10/1984 | Walker |
| D276,282 | S | 11/1984 | Burg |
| D277,298 | S | 1/1985 | Nelson |
| D277,299 | S | 1/1985 | Nelson |
| 4,510,851 | A | 4/1985 | Samosky et al. |
| D282,275 | S | 1/1986 | Price |
| D282,972 | S | 3/1986 | Castor et al. |
| 4,594,940 | A | 6/1986 | Wolbrink et al. |
| 4,610,705 | A | 9/1986 | Samosky et al. |
| D286,446 | S | 10/1986 | Caroli et al. |
| 4,628,802 | A | 12/1986 | Steiner et al. |
| D287,888 | S | 1/1987 | Castor et al. |
| D288,007 | S | 1/1987 | Jonas et al. |
| D288,396 | S | 2/1987 | Ritman |
| 4,681,024 | A | 7/1987 | Ivey |
| 4,722,266 | A | 2/1988 | Deckert |
| D295,675 | S | 5/1988 | Demarest |
| 4,754,697 | A | 7/1988 | Asselbergs |
| 4,776,798 | A | 10/1988 | Crawford |
| D300,777 | S | 4/1989 | Bales et al. |
| D300,847 | S | 4/1989 | Lin |
| 4,862,334 | A | 8/1989 | Ivey et al. |
| D303,436 | S | 9/1989 | Clyde-Mason |
| 4,867,640 | A | 9/1989 | Penlesky et al. |
| 4,991,496 | A | 2/1991 | Kuno et al. |
| D315,790 | S | 3/1991 | Koessler |
| D322,667 | S | 12/1991 | Fukuda et al. |
| D323,209 | S | 1/1992 | Fukumoto et al. |
| D323,554 | S | 1/1992 | Hoyt et al. |
| D325,434 | S | 4/1992 | Dosmann |
| D325,651 | S | 4/1992 | Sonneman |
| D328,650 | S | 8/1992 | Jones |
| D330,585 | S | 10/1992 | Saito et al. |
| D331,458 | S | 12/1992 | Saito et al. |
| D331,638 | S | 12/1992 | Vamberszky et al. |
| D334,053 | S | 3/1993 | Cook |
| 5,197,920 | A | 3/1993 | Ganse |
| D334,977 | S | 4/1993 | Avari |
| D336,895 | S | 6/1993 | Rogov |
| D338,954 | S | 8/1993 | Brock |
| D340,109 | S | 10/1993 | Julien |
| D341,442 | S | 11/1993 | Shapiro |
| 5,319,942 | A | 6/1994 | Paustian et al. |
| D349,778 | S | 8/1994 | Johnson et al. |
| D350,191 | S | 8/1994 | Tsuji |
| 5,333,830 | A | 8/1994 | Millen |
| D350,409 | S | 9/1994 | Johnson et al. |
| D352,564 | S | 11/1994 | Marischen |
| D357,732 | S | 4/1995 | Spechts et al. |
| D361,375 | S | 8/1995 | Gallagher et al. |
| D362,059 | S | 9/1995 | Wojcik |
| D366,521 | S | 1/1996 | Wijaranakula |
| D366,522 | S | 1/1996 | Lagace et al. |
| D367,924 | S | 3/1996 | Patel et al. |

(56) References Cited

U.S. PATENT DOCUMENTS

| | | | |
|---|---|---|---|
| D372,767 | S | 8/1996 | Borges |
| D372,775 | S | 8/1996 | Schuler |
| D374,927 | S | 10/1996 | Chabot |
| D375,350 | S | 11/1996 | Patel et al. |
| D376,214 | S | 12/1996 | Pinchuk |
| D376,639 | S | 12/1996 | Moore |
| D376,842 | S | 12/1996 | Franklin et al. |
| D377,535 | S | 1/1997 | Shulman |
| 5,601,485 | A | 2/1997 | Gigola |
| D378,698 | S | 4/1997 | Ukai et al. |
| 5,632,334 | A | 5/1997 | Grinbergs et al. |
| D382,549 | S | 8/1997 | Yoshimoto |
| D386,186 | S | 11/1997 | Schnetzer et al. |
| D386,209 | S | 11/1997 | Firestone et al. |
| D387,859 | S | 12/1997 | Ukai et al. |
| D388,353 | S | 12/1997 | Desborough et al. |
| D393,708 | S | 4/1998 | Assadi |
| D395,494 | S | 6/1998 | Becker |
| D396,275 | S | 7/1998 | Pearson |
| D398,417 | S | 9/1998 | Fritzsche et al. |
| 5,820,247 | A | 10/1998 | Schuler |
| D401,682 | S | 11/1998 | Galeazzi et al. |
| D403,442 | S | 12/1998 | Joss |
| D403,787 | S | 1/1999 | Van Belle |
| D404,508 | S | 1/1999 | Marischen |
| D405,207 | S | 2/1999 | Mora |
| D407,473 | S | 3/1999 | Wimbock |
| D407,521 | S | 3/1999 | Crosby |
| 5,879,232 | A | 3/1999 | Luter et al. |
| D409,449 | S | 5/1999 | Cornelissen |
| 5,918,972 | A | 7/1999 | Van Belle |
| D412,566 | S | 8/1999 | Taras et al. |
| D414,253 | S | 9/1999 | Kobayashi et al. |
| 5,971,847 | A | 10/1999 | Webb |
| D416,315 | S | 11/1999 | Nanjo |
| D416,349 | S | 11/1999 | Pahl |
| D417,307 | S | 11/1999 | Pahl |
| D418,909 | S | 1/2000 | Mockett |
| D420,121 | S | 2/2000 | Felix-Flender |
| 6,027,406 | A | 2/2000 | Yazici |
| D424,672 | S | 5/2000 | Nanjo |
| D425,974 | S | 5/2000 | Esty et al. |
| D426,124 | S | 6/2000 | Kassalen et al. |
| D426,292 | S | 6/2000 | Nanjo |
| D426,657 | S | 6/2000 | Joss |
| D427,009 | S | 6/2000 | Iyengar et al. |
| D427,303 | S | 6/2000 | Brown |
| D428,645 | S | 7/2000 | Rossman et al. |
| 6,227,962 | B1 | 5/2001 | Orendorff |
| 6,261,175 | B1 | 7/2001 | Larson et al. |
| 6,464,579 | B1 | 10/2002 | Salazar |
| 6,488,579 | B2 | 12/2002 | Larson et al. |
| 6,503,060 | B1 | 1/2003 | Kamada et al. |
| 6,537,146 | B1 | 3/2003 | Haynes |
| 6,651,454 | B1 | 11/2003 | Spiegel |
| 6,653,566 | B2 | 11/2003 | Petak et al. |
| 6,723,428 | B1 | 4/2004 | Foss et al. |
| 6,750,760 | B2 | 6/2004 | Albritton et al. |
| 6,889,948 | B2 | 5/2005 | Melancon et al. |
| 6,979,169 | B2 | 12/2005 | Penlesky et al. |
| 7,203,416 | B2 | 4/2007 | Craw et al. |
| 7,328,478 | B2 | 2/2008 | Jenkins |
| 7,537,647 | B2 | 5/2009 | Adair et al. |
| 7,581,717 | B1 | 9/2009 | Thurlkill |
| 7,596,960 | B2 | 10/2009 | Bae |
| D618,782 | S | 6/2010 | Zakula et al. |
| D626,644 | S | 11/2010 | Jacak et al. |
| 7,850,513 | B1 | 12/2010 | Parker et al. |
| D635,238 | S | 3/2011 | Zakula et al. |
| D653,323 | S | 1/2012 | Jacak et al. |
| D654,998 | S | 2/2012 | Zakula et al. |
| D655,403 | S | 3/2012 | Zakula et al. |
| D665,225 | S | 8/2012 | Zakula et al. |
| 8,256,241 | B2 | 9/2012 | Ikeda et al. |
| D678,995 | S | 3/2013 | Hoshino et al. |
| D701,952 | S | 4/2014 | Hoshino et al. |
| D706,916 | S | 6/2014 | Penlesky et al. |
| 8,864,447 | B1 | 10/2014 | Humphrey |
| 8,961,126 | B1 * | 2/2015 | Tom ..... F24F 13/078 415/213.1 |
| 9,022,846 | B1 * | 5/2015 | Tom ..... F21V 33/0096 454/338 |
| 9,028,212 | B1 | 5/2015 | Tom |
| 9,103,104 | B1 | 8/2015 | Tom |
| 9,131,814 | B2 | 9/2015 | Nakamura et al. |
| 9,182,138 | B2 | 11/2015 | Foreman et al. |
| 9,188,132 | B1 | 11/2015 | Tom |
| 9,212,668 | B2 | 12/2015 | Deng et al. |
| 9,303,859 | B2 | 4/2016 | Horng et al. |
| 9,303,888 | B2 | 4/2016 | Karst et al. |
| D759,800 | S | 6/2016 | Adrian et al. |
| D778,424 | S | 2/2017 | Jonas et al. |
| D778,425 | S | 2/2017 | Jonas et al. |
| D779,050 | S | 2/2017 | Jonas et al. |
| D784,511 | S | 4/2017 | Jonas et al. |
| D784,512 | S | 4/2017 | Jonas et al. |
| D799,677 | S | 10/2017 | Jonas et al. |
| D799,678 | S | 10/2017 | Jonas et al. |
| D799,679 | S | 10/2017 | Jonas et al. |
| D800,294 | S | 10/2017 | Jonas et al. |
| D800,295 | S | 10/2017 | Jonas et al. |
| D800,892 | S | 10/2017 | Jonas et al. |
| D815,724 | S | 4/2018 | Jonas et al. |
| D816,206 | S | 4/2018 | Jonas et al. |
| D822,821 | S | 7/2018 | Jonas et al. |
| D837,966 | S | 1/2019 | Adrian et al. |
| D842,449 | S | 3/2019 | Chang et al. |
| 10,694,278 | B2 * | 6/2020 | Ivey ..... H04R 1/22 |
| 2013/0088855 | A1 | 4/2013 | Ye |
| 2015/0093983 | A1 * | 4/2015 | Jeong ..... F24F 1/0047 454/248 |
| 2015/0117034 | A1 * | 4/2015 | Horng ..... F21V 29/677 362/373 |
| 2015/0125292 | A1 | 5/2015 | Karst |
| 2016/0069561 | A1 | 3/2016 | Jonas |

OTHER PUBLICATIONS

Chinese Application No. 201630055109.5, Office Action dated Jun. 1, 2016, 3 page.

Canadian Application No. 165,307, Response filed Jun. 15, 2016 to Office Action dated Feb. 15, 2016, 9 pages.

Canadian Application No. 165,355, Response filed Jun. 15, 2016 to Office Action dated Feb. 15, 2016, 6 pages.

Canadian Application No. 165,366, Response filed Jun. 15, 2016 to Office Action dated Feb. 15, 2016, 18 pages.

U.S. Appl. No. 29/514,061, Response filed Aug. 17, 2016 to Non Final Office Action dated May 19, 2016, 6 pages.

U.S. Appl. No. 29/514,063, Response filed Aug. 17, 2016 to Non Final Office Action dated May 19, 2016, 8 pages.

U.S. Appl. No. 29/514,067, Response filed Aug. 22, 2016 to Non Final Office Action dated May 20, 2016, 6 pages.

U.S. Appl. No. 29/514,073, Response filed Aug. 22, 2016 to Non Final Office Action dated May 20, 2016, 6 pages.

U.S. Appl. No. 29/514,970, Response filed Aug. 29, 2016 to Non Final Office Action dated May 27, 2016, 6 pages.

U.S. Appl. No. 29/538,019, Restriction Requirement dated Sep. 1, 2016, 7 pages.

Chinese Application No. 201630055109.5, Response filed Sep. 18, 2016 to Office Action dated Jun. 1, 2016, 8 pages.

U.S. Appl. No. 29/514,061, Final Office Action dated Sep. 19, 2016, 9 pages.

U.S. Appl. No. 29/514,073, Notice of Allowance dated Sep. 19, 2016, 8 pages.

U.S. Appl. No. 29/514,067, Notice of Allowance dated Sep. 20, 2016, 9 pages.

U.S. Appl. No. 29/514,070, Notice of Allowance dated Sep. 21, 2016, 6 pages.

Canadian Application No. 165,355, Response filed for Sep. 22, 2016 to Office Action dated Jul. 28, 2016, 2 pages.

(56) References Cited

OTHER PUBLICATIONS

U.S. Appl. No. 29/514,070, Corrected Notice of Allowance dated Oct. 5, 2016, 2 pages.
U.S. Appl. No. 29/514,073, Corrected Notice of Allowance dated Oct. 5, 2016, 2 pages.
U.S. Appl. No. 29/538,019, Examiner Interview Summary dated Oct. 11, 2016, 7 pages.
U.S. Appl. No. 29/514,063, Response filed Oct. 24, 2016 to Non Final Office Action dated May 19, 2016, 20 pages.
Canadian Application No. 169,274, Office Action dated Oct. 25, 2016, 2 pages.
U.S. Appl. No. 29/538,019, Response filed Nov. 1, 2016 to Restriction Requirement dated Sep. 1, 2016, 4 pages.
Canadian Application No. 167,117, Response filed Nov. 3, 2016 to Office Action dated Jul. 14, 2016, 10 pages.
U.S. Appl. No. 29/514,061, Response filed Nov. 21, 2016 to Final Office Action dated Sep. 19, 2016, 16 pages.
U.S. Appl. No. 29/538,019, Notice of Allowance dated Nov. 23, 2016, 9 pages.
U.S. Appl. No. 29/539,396, Notice of Allowance dated Feb. 27, 2017, 9 pages.
U.S. Appl. No. 29/539,401, Notice of Allowance dated Feb. 27, 2017, 8 pages.
U.S. Appl. No. 29/539,391, Notice of Allowance dated Mar. 1, 2017, 8 pages.
U.S. Appl. No. 29/539,405, Notice of Allowance dated Mar. 1, 2017, 8 pages.
U.S. Appl. No. 29/539,409, Notice of Allowance dated Mar. 2, 2017, 8 pages.
U.S. Appl. No. 29/539,392, Notice of Allowance dated Mar. 3, 2017, 8 pages.
U.S. Appl. No. 29/539,415, Notice of Allowance dated Mar. 9, 2017, 8 pages.
U.S. Appl. No. 29/539,414, Notice of Allowance dated Mar. 13, 2017, 2 pages.
U.S. Appl. No. 29/539,414, Corrected Notice of Allowance dated Mar. 31, 2017, 2 pages.
Broan QTX110SL Media Gallery, Broan QTX110SL Combination Fan, Light, Night-Light, 110 CFM, 0.9 Sones, Humidity Sensing, ventingdirect.com, 1 page.
Emerson Environment Products, Whole House Fan and Shutter System Owners Manual, Dec. 1982, cited by other.
Photographs of Panasonic Ventilating Fan, Model FV-11, VHL1, available prior to Jan. 2, 2008, 3 pages.
Spartan Electric Company, Direct Drive Whole House Fans Publication, available prior to Jan. 2, 2008.
"Whirpool 30 and 36 Range Hood Models UXT3030AY/UXT3036AY." Installation Instructions and Use & Care Guide, [online], Retrieved from the Internet: <http://www.whirlpool.ca/digitalassests/UXT3030AYB/US%20and%20Care_EN.pdf>, 2011. 28 pages.
"Maytag 30 in. Non-Vented Range Hood in Stainless Steel," Model# UXT4030AYS, Home Depot, [online], Retrieved from the Internet on Sep. 23, 2013: <http://www.homedepot.com/p/Maytag-30-in-Non-Vented-Range-Hood-in-Stainless-Steel-UXT 4030AYS/202832999#customer_reviews>, 5 pages.
"Finnleo Steam Sauna Ventilation Wood Grill," online, Retrieved from the Internet: <https://www.tineye.com/search/8ff8db465e46f58bcad482160583c- b539dc23fa4/, Jun. 6, 2012.
U.S. Appl. No. 11/968,250 Non Final Office Action dated Sep. 20, 2012, 21 pages.
U.S. Appl. No. 11/968,250, Response filed Dec. 20, 2012 to Non-Final Office Action dated Sep. 20, 2012, 26 pages.
U.S. Appl. No. 11/968,250, Non Final Office Action dated Mar. 26, 2013, 20 pages.
U.S. Appl. No. 11/968,250, Response filed May 24, 2013 to Final Office Action dated Mar. 26, 2013, 20 pages.
U.S. Appl. No. 11/968,250, Advisory Action dated Jun. 24, 2013, 3 pages.
U.S. Appl. No. 11/968,250, Non Final Office Action dated Aug. 22, 2013, 18 pages.
U.S. Appl. No. 29/458,592, Non Final Office Action dated Sep. 27, 2013, 7 pages.
U.S. Appl. No. 11/968,250, Response filed Nov. 8, 2013 to Non Final Office Action dated Aug. 22, 2013, 23 pages.
Grille Images, image post date Nov. 23, 2013, site visited May 14, 2016, [online], <https://www.tineye.com/search/ea95b48bdc1fce15b6d68e4fbe33c- 0e4e7566460/>.
U.S. Appl. No. 29/458,592, Response filed Dec. 27, 2013 to Non Final Office Action dated Sep. 27, 2013, 8 pages.
U.S. Appl. No. 11/968,250, Final Office Action dated Jan. 22, 2014, 18 pages.
U.S. Appl. No. 29/458,592, Notice of Allowance dated Mar. 4, 2014. 6 pages.
Napoleon Prestige Pro 450-Natural Gas, image post date Apr. 5, 2014, site visited May 15, 2016, [online], <http://web.archive.org/web/20140405111728/http://www.bbqworld.co.uk/n- apoleon/napoleon-prestige-pro-450-natural-gas.asp>.
"Ultra Green Series," [online], Retrieved from Internet: <http://web.archive.org/web/20140416053348/http://www.borancom/products/filter/ultra-406c-abf1-ed72241eb706>, Apr. 16, 2014.
"Airvent 435103 Kitchen Extractor Fan," [online], Retrieved from Internet: <https://www.amazon.co.uk/Airvent-435103-Kitchen-Extractor-1-50mm/dp/B0085TQ75U/ref=pd.sub.—cp.sub.—107.sub.—3?ie=UTF8&refRID=1MXRP1-Q1QR5H6NZ1MR7C., May 14, 2014.
U.S. Appl. No. 11/968,250, Response filed May 22, 2014 to Final Office Action dated Jan. 22, 2014, 12 pages.
U.S. Appl. No. 11/968,250, Non Final Office Action dated Jun. 19, 2014, 18 pages.
U.S. Appl. No. 11/968,250, Response filed Sep. 19, 2014 to Non Final Office Action dated Jun. 19, 2014, 11 pages.
Air Vent Grille Cover, image post date Nov. 9, 2014, site visited May 14, 2016, [online], <https://www/tineye.com/search/232b8f674998285163e7a3de47a03ed0ef9b1dc- 6/>.
U.S. Appl. No. 11/968,250, Final Office Action dated Nov. 26, 2014, 20 pages.
"Manrose FF100P Bathroom Fan," [online], Retrieved from Internet: <https://www.tineye/com/search63988ff8b950dad9cb1aaec51119050bdd00cf2- 1/?pluginver=>, Dec. 12, 2014.
U.S. Appl. No. 29/458,589, Restriction Requirement dated Apr. 9, 2015, 7 pages.
U.S. Appl. No. 29/458,589, Response filed Apr. 27, 2015 to Restriction Requirement dated Apr. 9, 2015, 4 pages.
Canadian Application No. 163,017, Office Action dated Nov. 9, 2015, 3 pages.
Canadian Application No. 163,018, Office Action dated Nov. 9, 2015, 2 pages.
Canadian Application No. 163,019, Office Action dated Nov. 9, 2015, 2 pages.
Canadian Application No. 163,015, Office Action dated Nov. 10, 2015, 7 pages.
Canadian Application No. 163,016, Office Action dated Nov. 10, 2015, 2 pages.
U.S. Appl. No. 29/521,663, Restriction Requirement dated Dec. 3, 2015, 3 pages.
U.S. Appl. No. 29/521,663, Response filed Feb. 2, 2016 to Restriction Requirement dated Dec. 3, 2015, 10 pages.
U.S. Appl. No. 29/521,663, Notice of Allowance dated Feb. 12, 2016, 7 pages.
Canadian Application No. 165,307, Office Action dated Feb. 15, 2016, with English Translation, 4 pages.
Canadian Application No. 165,366, Office Action dated Feb. 16, 2016, with English Translation, 4 pages.
Canadian Application No. 165,017, Response filed Mar. 9, 2016 to Office Action dated Nov. 9, 2015, 8 pages.
Canadian Application No. 165,018, Response filed Mar. 9, 2016 to Office Action dated Nov. 9, 2015, 7 pages.
Canadian Application No. 165,019, Response filed Mar. 9, 2016 to Office Action dated Nov. 9, 2015, 7 pages.

(56) References Cited

OTHER PUBLICATIONS

Canadian Application No. 165,015, Response filed Mar. 10, 2016 to Office Action dated Nov. 10, 2015, 7 pages.
U.S. Appl. No. 29/514,061, Non Final Office Action dated May 19, 2016, 19 pages.
U.S. Appl. No. 29/514,063, Non Final Office Action dated May 19, 2016, 22 pages.
U.S. Appl. No. 29/514,067, Non Final Office Action dated May 20, 2016, 20 pages.
U.S. Appl. No. 29/514,073, Non Final Office Action dated May 20, 2016, 21 pages.
Admitted Prior Art NuTone 791LEDNT Fan/Light.

* cited by examiner

GRILLE ATTACHMENT SYSTEM FOR A VENTILATION SYSTEM

TECHNICAL FIELD

The present disclosure relates generally to a ventilation system that is installed in a ceiling of a room to provide ventilation and particularly to a ventilation system including a housing and a grille. More particularly, the present disclosure relates to a system in which the grille comprises a trim ring connected to the housing and a plate releasably secured to the trim ring.

BACKGROUND

Conventional ventilation fans, such as those typically installed in a room of a building structure, such as a bathroom, can draw air from within an area of the room, through the fan and exhaust the air to another location, such as through a vent in the gable or roof of a home or other building structure. Many conventional ventilation fans include a housing positioned within or adjacent an aperture formed in a wall or ceiling and include a grille covering the opening to obscure view of the aperture and access to fan. Grilles are typically removable for cleaning or maintenance and may be retained to the ventilation fan using conventional grille springs such as the grille 10 and springs 12 depicted in FIGS. 1A and 1B. During installation of the grille to a fan housing 14, the springs 12 typically need to be compressed into the configuration depicted in FIGS. 1A and 1B. In some instances, it may be difficult to simultaneously compress the spring 12 and position the spring 12 in a proper location for installation, such as the fan housing bracket 16 depicted in FIG. 1B. This difficulty is compounded because a user must reach around the grille 10 while holding the grille 10 adjacent to the fan housing 14, which leaves little room for the user's hands. The presence of a blower 15 in the fan housing 14 could further complicate installation. Moreover, while holding the grille 10 adjacent to the fan housing 14, the user must locate first and second tongs 12*a*, 12*b* of the spring 12 into first and second bracket arms 16*a*, 16*b* of the fan housing 12, typically without an ability to see the spring 12 or the bracket 16 because the grille 10 obstructs the users view of the spring 12 and/or bracket 16. While the connected spring 12 and bracket 16 are visible in FIG. 1B, connection of the opposing spring 12 and bracket (not visible in FIG. 1B) will not provide the same visibility because the grille 10 will be pulled adjacent the fan housing 14 leaving only a small gap between the grille 10 and the fan housing 14 about the entire perimeter of the grille 10.

Therefore, a need exists for a grille attachment system that allows the grille to be installed to the fan housing with minimal effort from the user. A full discussion of the features and advantages of the present disclosure is deferred to the following detailed description, which proceeds with reference to the accompanying drawings.

The description provided in the background section should not be assumed to be prior art merely because it is mentioned in or associated with the background section. The background section may include information that describes one or more aspects of the subject technology.

BRIEF DESCRIPTION OF THE DRAWINGS

The accompanying drawings, which are included to provide further understanding and are incorporated in and constitute a part of this specification, illustrate disclosed embodiments and together with the description serve to explain the principles of the disclosed embodiments. In the drawings.

In one or more implementations, not all of the depicted components in each figure may be required, and one or more implementations may include additional components not shown in a figure. Variations in the arrangement and type of the components may be made without departing from the scope of the subject disclosure. Additional components, different components, or fewer components may be utilized within the scope of the subject disclosure.

DETAILED DESCRIPTION

Figure 5:
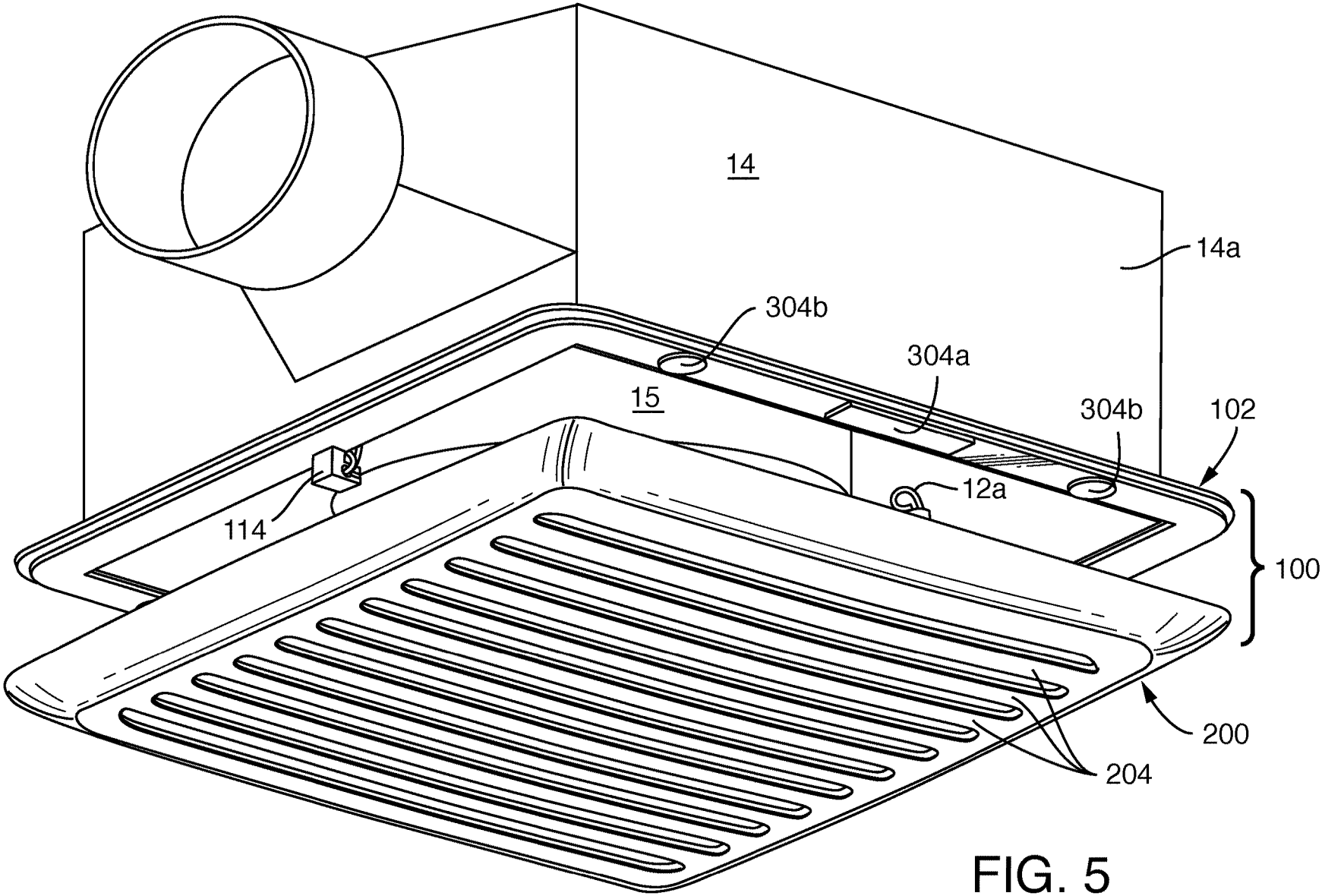
FIG. 5 is a perspective view of the plate of FIG. 4 in association with the trim ring of FIG. 3.

FIG. 5 depicts one embodiment of a ventilation system including a grille 100, in accordance with the present disclosure, having a trim ring 102 and a plate 200 for selective association with a fan housing 14 having a blower 15. The ventilation system is configured to be positioned in a room of a building structure to provide ventilation for the room of the building structure. For example, the ventilation system may be positioned in a ceiling panel (not shown) of the room and aligned with a cutout in the ceiling panel to ventilate the room. The fan housing 14 has an external wall structure 14*a* that defines an internal region 14*b* to house the blower 15. The blower 15 can include a motor and a bladed rotor that is configured to rotate about an axis within the housing 14 and move air through the housing and provide ventilation to the room.

Figure 1A:
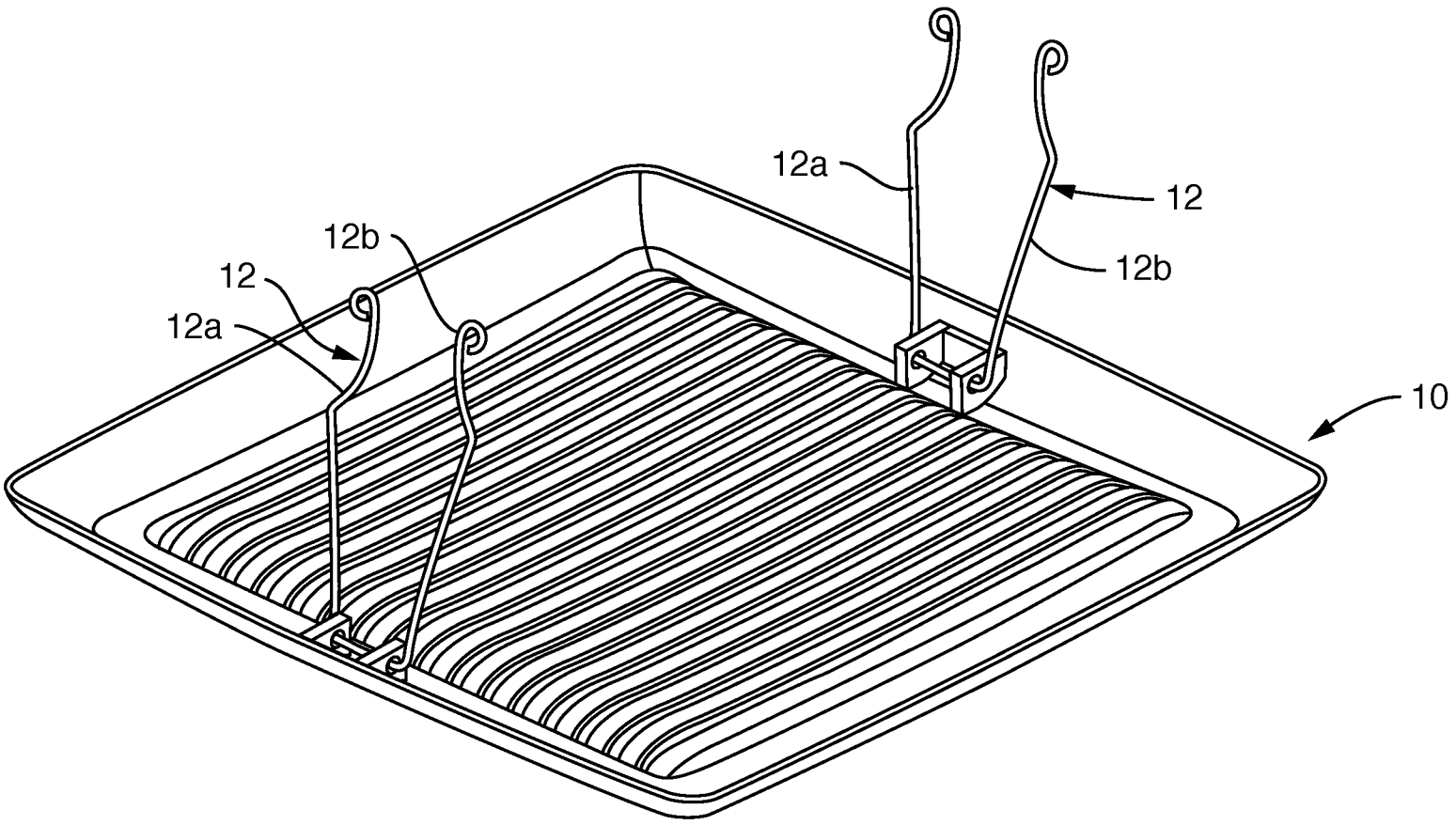
FIG. 1A is a perspective view of a traditional grille and spring connection system for connecting a grille to a fan housing.
Figure 1B:
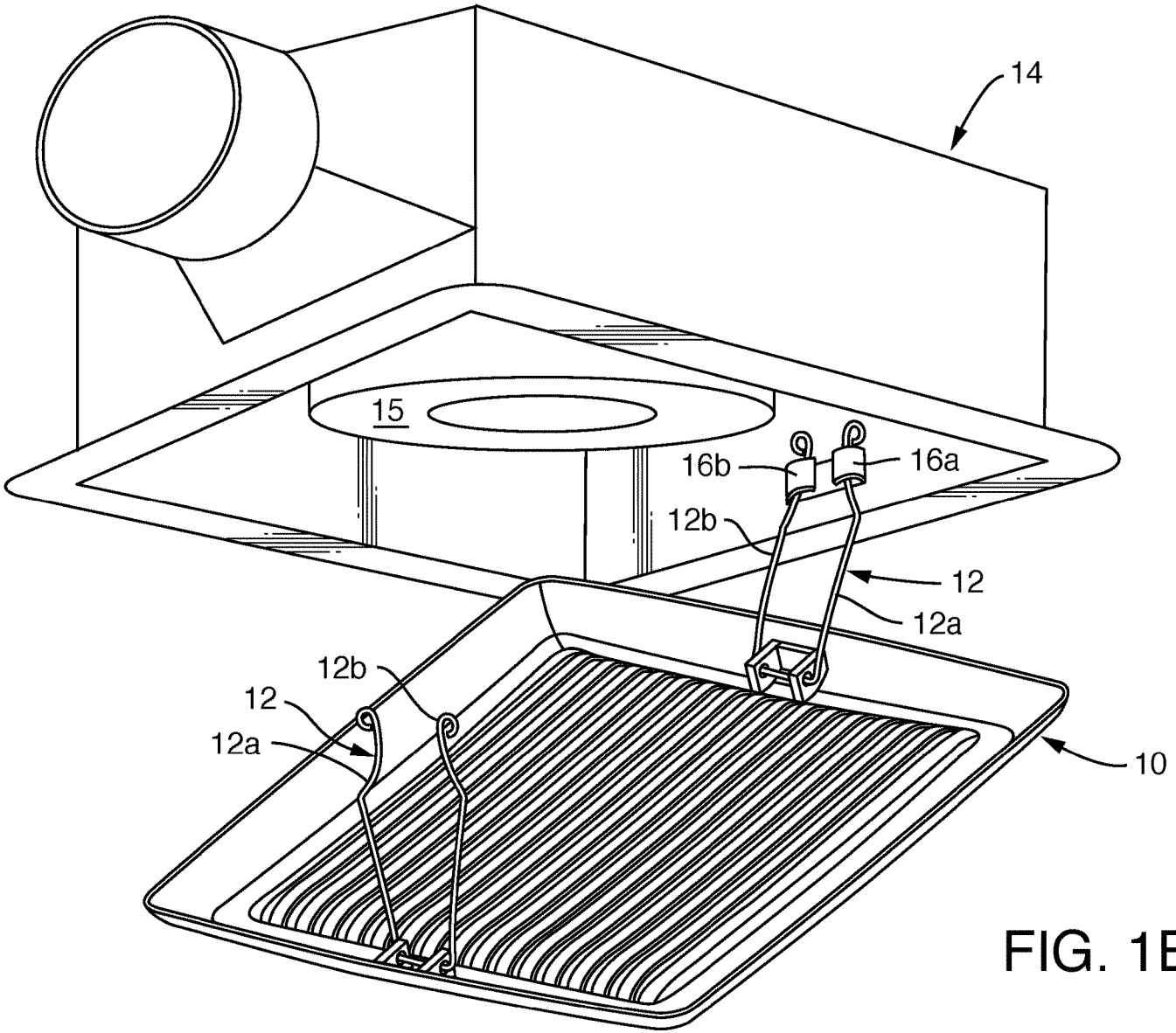
FIG. 1B is a perspective view of a traditional grille and spring connection system in relation to a traditional fan housing.
Figure 2:
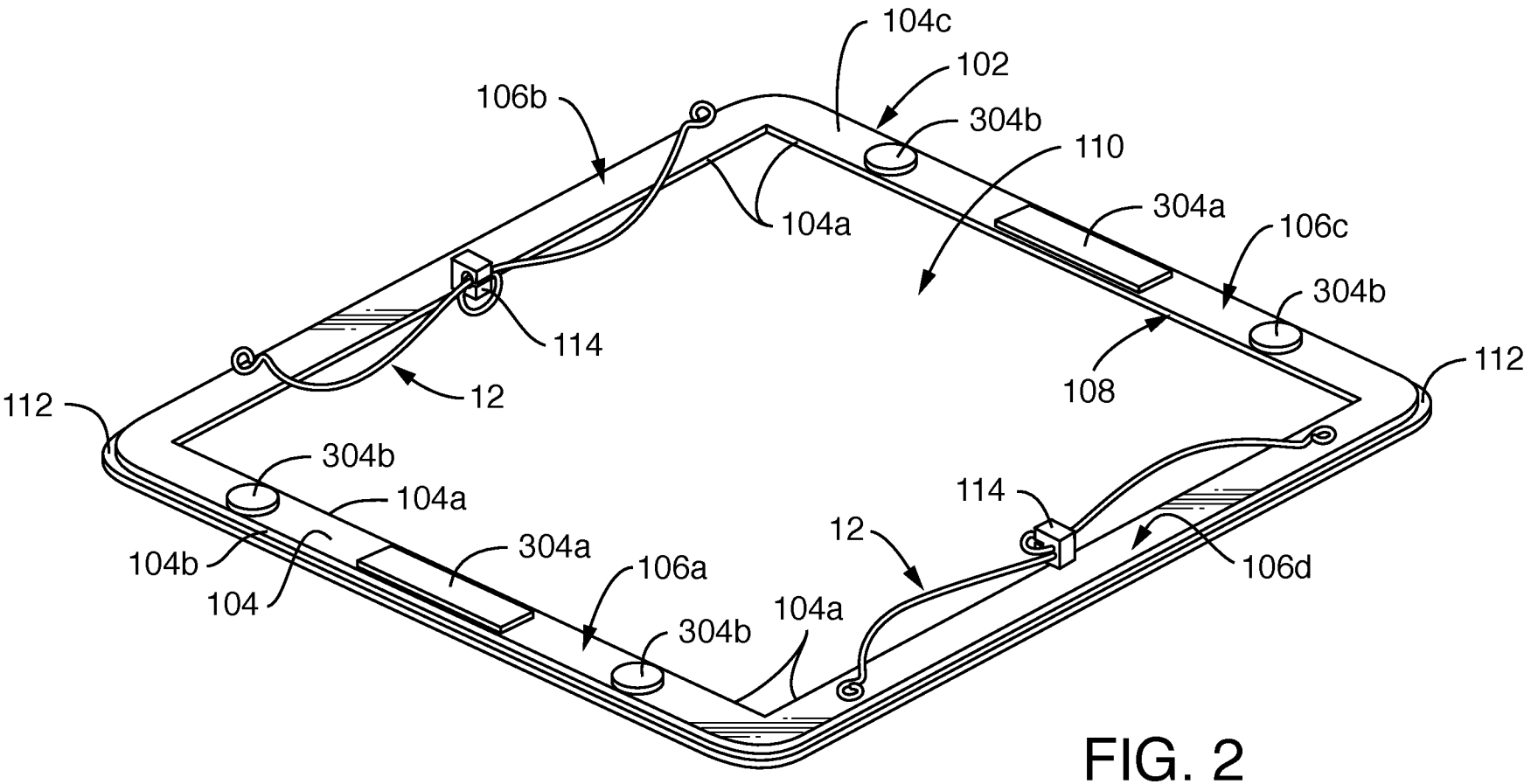
FIG. 2 is a perspective view of one embodiment of a trim ring of this disclosure.

FIG. 2 depicts one embodiment of the trim ring 102 of the present disclosure. The trim ring 102 has a rail 104 having an inner edge 104*a* and an outer edge 104*b* as well as a top surface 104*c* and a bottom surface 104*d*. The rail 104 extends to define four side elements 106*a*, 106*b*, 106*c* and 106*d* arranged in a substantially square configuration such that the rail inner edges 104*a* form a substantially square internal perimeter 108 of the trim ring 102, which defines an aperture 110. The trim ring 102 can have greater or fewer side elements 106, including a single side element 106 defining a circle. Additionally, the trim ring 102 can form any shape and can define any shape aperture 110.

A foot flange 112 extends from the rail outer edge 104*b* adjacent its bottom surface 104*d* and around the entire trim ring. The foot flange 112 is relatively narrow compared to the width of the rail 104 and offsets the rail 104 from an adjacent ceiling due to the fact that the foot flange 112 is located adjacent the rail bottom surface 104*d*. When the trim ring 102 is placed against a ceiling or other surface, the foot flange 112 contacts the ceiling or other surface and spaces the rail 104 from the ceiling or other surface to define a clearance gap there between. This clearance gap allows the foot flange 112 to sit flush with the ceiling or other surface even if the fan housing is mounted slightly below, or sags from, that ceiling or other surface. In one embodiment, the trim ring 102 is configured to define a clearance gap of approximately 0.1875 inches, but other clearance gap dimensions are also contemplated.

A mounting boss 114 extends from the rail 104 of two opposing side elements 106, depicted in FIG. 2 as the second 106*b* and fourth 106*d* side elements. In the depcited embodiment, each mounting boss 114 retains a grille spring 12 at its center between first and second spring tongs 12*a*, 12*b* for mounting the trim ring 102 to the fan housing 14. In the depicted embodiment, the mounting boss 114 is a block defining a through hole to receive a traditional grille spring 12. The block may also define a slot providing a path to slide the spring through the block and into the through hole.

In an alternative embodiment, the trim ring 102 could attach to the housing using any known connection mechanism instead of the depicted grille springs 12. The trim ring mounting boss 114 will be modified from the depicted embodiment to secure the chosen connection mechanism to the trim ring 102.

Figure 3:
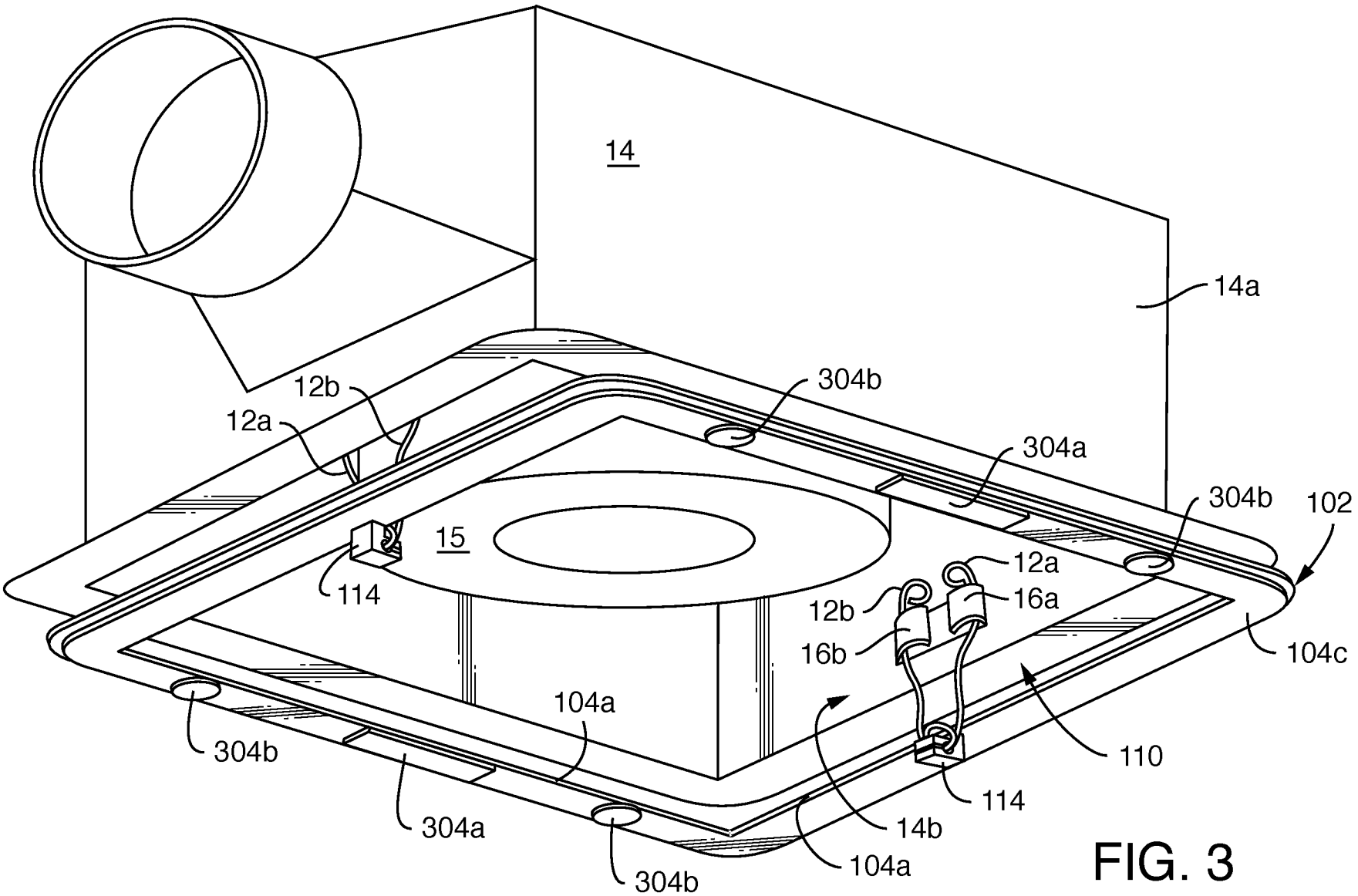
FIG. 3 is a perspective view of the trim ring of FIG. 2 associated with a traditional fan housing.
Figure 4:
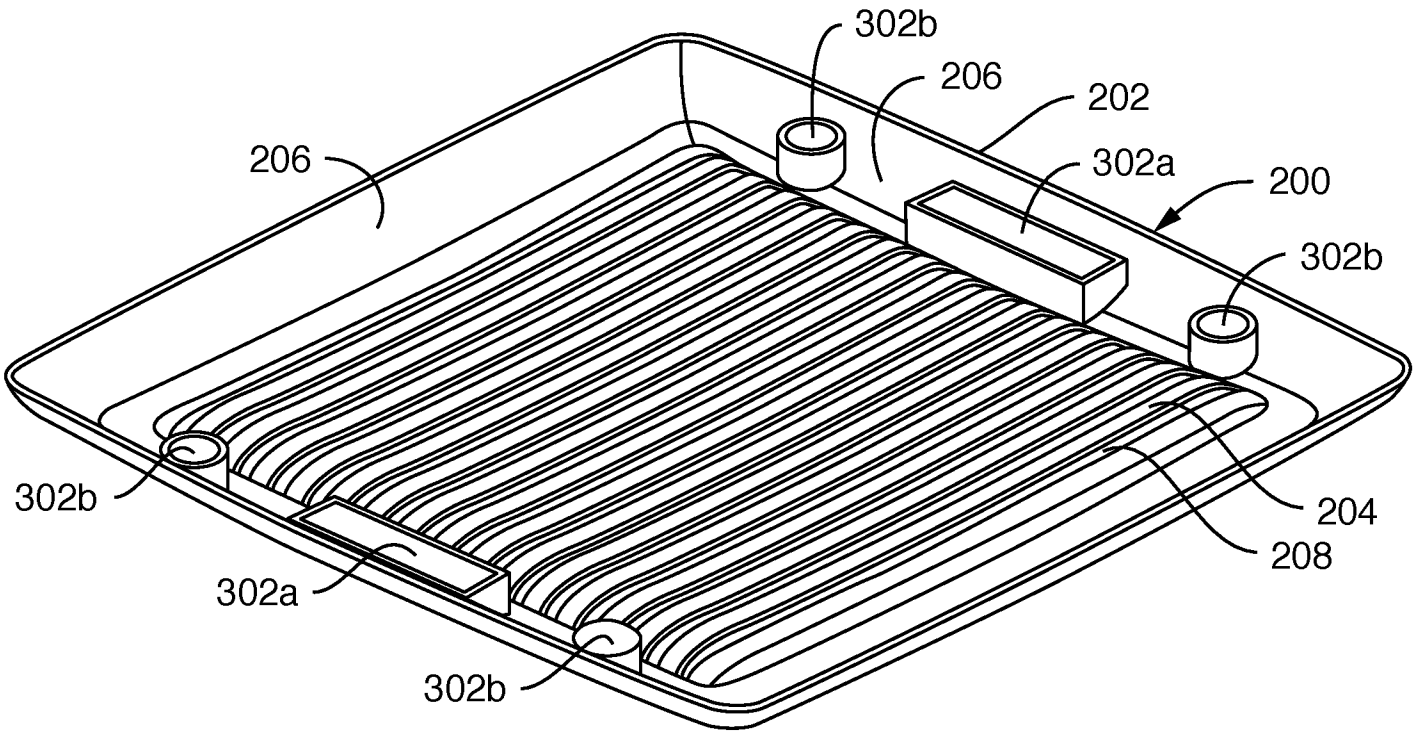
FIG. 4 is a perspective view of one embodiment of a plate of this disclosure.

As depicted in FIG. 3, trim ring aperture 110 defined by the side element 106 inner edges 104*a* provides easy access to the grille springs 12 so that the grille springs 12 may be easily connected by a user to fan housing brackets 16. The trim ring aperture 110 allows the hands of a user to pass therethrough and grasp the grille springs 12 (or other chosen connection mechanism) throughout the entire process of installing the trim ring 102. Additionally, the trim ring aperture 110 provides a user with an unobstructed view of the grille springs 12 and the housing brackets 16.

The plate 200 is removably coupled to the trim ring 102 and is configured to obscure view of, and access to, the cutout in the ceiling, the fan housing 14, and the blower 15 from within the room. The plate 200 provides a more aesthetic appearance of the ventilation system from the room to which the ventilation system is connected. The plate 200 includes an outer periphery 202 that defines an outermost dimension of the plate 200. In the depicted embodiment, the plate 200 comprises a plurality of ribs 204 that extend across the plate 200, but not to the outer periphery 202, leaving a peripheral rim 206. The ribs 204 are spaced apart from one another to define slotted apertures 208 therebetween. The apertures 208 do not extend into the peripheral rim 206. The apertures 208 allow air to flow between the ribs 204, so that it may travel through the trim ring aperture 110 and then into the fan housing 14. In the depicted embodiment, the ribs 204 are parallel to one another and evenly sized and spaced. Other embodiments having any size, shape, length (e.g., extending into the outer periphery 202), and/or number of ribs or apertures 208 is suitable.

In an alternative embodiment (not depicted), the plate 200 may define no apertures. Instead of air flowing through apertures in the plate 200, air may flow around the plate 200, between the plate 200 and the trim ring 102, then through the trim ring aperture 110 before entering the fan housing 14. In this alternative embodiment, the manner of removably coupling the plate 200 to the trim ring 102 must facilitate and permit the plate outer periphery 202 being spaced from the ceiling in order to allow air to flow therebetween.

The plate outer periphery 202 is preferably sized larger than the cutout in the ceiling and the fan housing 14 to obscure view of the cutout and the main housing 14 when the grille 100 is fully installed. The plate outer periphery 202 may be larger or smaller than the outer periphery of the trim ring 102.

The grille 100 comprises an attachment mechanism 300 to releasably couple the plate 200 to the trim ring 102. The attachment mechanism facilitates retention of the plate 200 in an installed position with the trim ring 102 while allowing for easy removal and/or installation of the plate 200 as described above.

In the depicted embodiment, the attachment mechanism 300 comprises a plurality of plate magnets 302 spaced apart from one another along the peripheral rim 206 of the plate 200 and a corresponding plurality of trim ring magnets 304 spaced apart from one another on the trim ring 102 in a manner allowing the trim ring magnets 304 to mate with the plate magnets 302. In alternative embodiments, some of the magnets 302, 304 may be replaced with a ferromagnetic metal to create attached with an opposing magnet 302, 304. In other alternative embodiments, the magnets are replaced with any known attachment mechanisms and arranged in any desired configuration to facilitate attachment of the plate 200 to the trim ring 102.

In the depicted embodiment, the plate magnets 302 comprise a first plate magnet 302*a* positioned on the peripheral rim 206 at a first side of the plate 200 and another first plate magnet 302*a* on the peripheral rim 206 at an opposing side of the plate 200. The first plate magnets 302*a* are each rectangular in shape. A pair of second plate magnets 302*b* are cylindrical in shape and are located in the plate peripheral rim 206 on either side of each first plate magnet 302*a*. In the depicted embodiment, the trim ring magnets 304 comprise a first trim ring magnet 304*a* positioned on the trim ring rail 104 on its top surface 106*c* and another first trim ring magnet 304*a* on the trim ring rail 104 at an opposing side element of the trim ring. The first trim ring magnets 304*a* are each rectangular in shape. A pair of second trim ring magnets 304*b* are circular in shape and are located on either side of each first trim ring magnet 304*a*. The magnets may be secured directly to the trim ring 102 or plate 200 or may be housed in a boss on the trim ring 102 or plate 200.

In the depicted embodiment, the attachment mechanism 300 is attached to the plate 200 and the trim ring 102 on only two sides of the system as described above and shown. In this arrangement, space is provided on the other two sides of the system for other structures or features to be included in the system such as the mouting bosses 114 on the trim ring 102. However, in other embodiments, it is contemplated that the attachment feature may be arranged on all four sides of the system, along three sides of the system, or on only one side of the system.

One or more additional features may be provided to the trim ring 102 and/or the plate 200. For example, the trim ring 102 and/or the plate 200 may be provided with features such as lighting, speakers, sensors (e.g., occupancy, humidity or other air quality, etc.) and/or radio frequency connectivity (e.g., Bluetooth, WiFi, etc.) or any other desired feature. Additionally, once the plate 200 is separated from the trim ring 102, the ventilation system may be retrofitted with another plate 200 to provide the ventilation system with a plate 200 having a different configuration, a different aesthetic appearance or a grille having different features, such as lighting, sensors (e.g., occupancy, humidity or other air quality, etc.) and/or radio frequency connectivity (e.g., Bluetooth, WiFi, etc.).

In one embodiment (not depicted), the attachment mechanism 300 acts to transmit electricity or signals from the trim ring 102 to the plate 200 in order to provide electricity or signals to additional features, described above, that are provided on the plate 200. In one example, a portion of the attachment mechanism 300 on the trim ring 102 may constitute or comprise an electrical plug or receptacle while a corresponding portion of the attachment mechanism 300 on the plate 200 may comprise or constitute a mating electrical plug or receptacle. In this embodiment, the trim ring 102 could be connected to the power provided to the blower 15 such that power is run to the plug or receptacle on the trim ring 102 and power would then be provided to the plate 200 upon coupling via the attachment mechanism 300 in order to power any of the aforementioned additional features. In an alternative embodiment, the electrical plug and receptacle can be separate from any attachment mechanism. In yet another alternative embodiment, the plate 200 could have a separate lead with an electrical plug or receptacle to connect to the power provided to the blower 15.

While preferred embodiments have been described above and illustrated in the accompanying drawings, it will be evident to those skilled in the art that modifications may be made without departing from this disclosure. Such modifications are considered as possible variants comprised in the scope of the disclosure. Headings and subheadings, if any, are used for convenience only and do not limit the disclosure. The word exemplary is used to mean serving as an example or illustration. To the extent that the term include, have, or the like is used, such term is intended to be inclusive in a manner similar to the term comprise as comprise is interpreted when employed as a transitional word in a claim. Relational terms such as first and second and the like may be used to distinguish one entity or action from another without necessarily requiring or implying any actual such relationship or order between such entities or actions.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

All numbers and ranges disclosed above may vary by some amount. Whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

A phrase "at least one of" preceding a series of items, with the terms "and" or "or" to separate any of the items, modifies the list as a whole, rather than each member of the list. The phrase "at least one of" does not require selection of at least one item; rather, the phrase allows a meaning that includes at least one of any one of the items, and/or at least one of any combination of the items, and/or at least one of each of the items. By way of example, each of the phrases "at least one of A, B, and C" or "at least one of A, B, or C" refers to only A, only B, or only C; any combination of A, B, and C; and/or at least one of each of A, B, and C.

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

The use of the terms "a" and "an" and "the" and "said" and similar references in the context of describing the disclosure (especially in the context of the following claims) are to be construed to cover both the singular and the plural, unless otherwise indicated herein or clearly contradicted by context. An element proceeded by "a," "an," "the," or "said" does not, without further constraints, preclude the existence of additional same elements. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the disclosure and does not pose a limitation on the scope of the disclosure unless otherwise claimed. No language in the specification should be construed as indicating any non-claimed element as essential to the practice of the disclosure.

Numerous modifications to the present disclosure will be apparent to those skilled in the art in view of the foregoing description. Preferred embodiments of this disclosure are described herein, including the best mode known to the inventors for carrying out the disclosure. It should be understood that the illustrated embodiments are exemplary only, and should not be taken as limiting the scope of the disclosure.

We claim:

1. A ventilation system comprising a main housing defining an internal region and the main housing configured to be positioned adjacent to a room of a building structure, a blower in the internal region and configured to draw air out of the room of the building structure, and a grille configured to at least partially block view of the main housing and the blower, the grille comprising:

a trim ring releasably connectable to the main housing or the blower by a grille spring, the trim ring defining an aperture through which the air is configured to flow and providing access to the main housing or blower when the trim ring is connected to the main housing or blower; and a plate configured to releasably connect to the trim ring to cover the aperture.

2. The system of claim 1, wherein the trim ring aperture provides access to the grille spring when the trim ring is connected to the main housing or blower.

3. The system of claim 1, wherein the plate is releasably connected to the trim ring by an attachment mechanism.

4. The system of claim 1, wherein the plate is releasably connected to the trim ring by an attachment mechanism and the attachment mechanism comprises a magnet.

5. The system of claim 1, wherein the plate defines apertures to allow movement of air through the plate.

6. A grille configured to be connected to a ventilation system comprising a main housing defining an internal region and a blower in the internal region and configured to move air, the grille comprising:

a trim ring releasably connectable to the main housing or the blower by a grille spring, the trim ring defining an aperture through which the air is configured to flow and providing access to the main housing or blower when the trim ring is connected to the main housing or blower; and a plate configured to releasably connect to the trim ring to cover the aperture.

7. The grille of claim 6, wherein the trim ring aperture provides access to the grille spring when the trim ring is connected to the main housing or blower.

8. The grille of claim 6, wherein the plate is releasably connected to the trim ring by an attachment mechanism.

9. The grille of claim 6, wherein the plate is releasably connected to the trim ring by an attachment mechanism and the attachment mechanism comprises a magnet.

10. The grille of claim 6, wherein the plate defines apertures to allow movement of air through the plate.

11. A grille configured to be connected to a ventilation system comprising a main housing defining an internal region and a blower in the internal region and configured to move air, the grille comprising:

a trim ring having a grille spring for connecting the trim ring to the main housing or the blower, the trim ring defining an aperture through which the air is configured to flow and providing access to the main housing or blower when the trim ring is connected to the main housing or blower; and a plate configured to releasably connect to the trim ring to cover the aperture.

12. The grille of claim 11, wherein the trim ring aperture provides access to the grille spring when the trim ring is connected to the main housing or blower.

13. The grille of claim 11, wherein the plate is releasably connectable to the trim ring by an attachment mechanism.

14. The grille of claim 11, wherein the plate is releasably connectable to the trim ring by an attachment mechanism and the attachment mechanism comprises a magnet.

15. The grille of claim 11, wherein the plate defines apertures to allow movement of air through the plate.

16. A ventilation system comprising a main housing defining an internal region and the main housing configured to be positioned adjacent to a room of a building structure, a blower in the internal region and configured to draw air out of the room of the building structure, and a grille configured to at least partially block view of the main housing and the blower, the grille comprising:

a trim ring releasably connectable to the main housing or the blower by a grille spring; and a plate for releasably connecting to the trim ring wherein the trim ring defines an aperture through which the air is configured to flow and providing access to the main housing or blower when the trim ring is connected to the main housing or blower.

17. A grille for connection to a ventilation system comprising a main housing defining an internal region and a blower in the internal region and configured to move air, the grille comprising:

a trim ring releasably connectable to the main housing or the blower by a grille spring; and a plate for releasably connecting to the trim ring;

wherein the trim ring defines an aperture through which the air is configured to flow and providing access to the main housing or blower when the trim ring is connected to the main housing or blower.

18. A grille for connection to a ventilation system comprising a main housing defining an internal region and a blower in the internal region and configured to move air, the grille comprising:

a trim ring having a connection mechanism for connecting the trim ring to the main housing or the blower; and a plate for releasably connectable to the trim ring;

wherein the trim ring defines an aperture through which the air is configured to flow and provides access to the connection mechanism and the main housing or blower when the trim ring is connected to the main housing or blower.

19. The grille of claim 18, wherein the connection mechanism is a grille spring.

* * * * *